US006622867B2

(12) United States Patent
Menceles

(10) Patent No.: US 6,622,867 B2
(45) Date of Patent: Sep. 23, 2003

(54) PACKAGE

(75) Inventor: Andrew Z. Menceles, Willowdale (CA)

(73) Assignee: Cosmoda Concept Corporation, Downsview (CA)

( * ) Notice: Subject to any disclaimer, the term of this patent is extended or adjusted under 35 U.S.C. 154(b) by 0 days.

(21) Appl. No.: 10/190,287

(22) Filed: Jul. 5, 2002

(65) Prior Publication Data

US 2003/0155271 A1 Aug. 21, 2003

Related U.S. Application Data

(60) Provisional application No. 60/357,896, filed on Feb. 19, 2002.

(51) Int. Cl.[7] ..... B65D 25/54

(52) U.S. Cl. ..... 206/771; 206/461; 206/471

(58) Field of Search ..... 206/1.5, 461, 471, 206/756, 763, 764–769, 771, 775–778; 220/324, 326, 782, 784–789

(56) References Cited

U.S. PATENT DOCUMENTS

| | | | | |
|---|---|---|---|---|
| 3,161,339 A | * | 12/1964 | Weller | 206/586 |
| 3,406,816 A | * | 10/1968 | Green et al. | 206/776 |
| 4,071,064 A | * | 1/1978 | Saul | 220/324 |
| 4,520,921 A | * | 6/1985 | Vissing | 220/326 |
| 4,741,440 A | | 5/1988 | Harris | |
| 4,802,577 A | * | 2/1989 | O'Leary | 206/776 |
| 5,100,052 A | | 3/1992 | Vajtay | |
| 5,582,293 A | * | 12/1996 | Kay | 206/775 |
| 5,755,327 A | * | 5/1998 | Saltzman et al. | 206/775 |

FOREIGN PATENT DOCUMENTS

| | | |
|---|---|---|
| EP | 0 347 001 | 12/1989 |
| EP | 0 567 249 A1 | 10/1993 |

* cited by examiner

*Primary Examiner*—Luan K. Bui
(74) *Attorney, Agent, or Firm*—D. Peter Hochberg; Katherine R. Vieryra; Sean Mellino

(57) ABSTRACT

A clear package for enabling a packaged product to appear to be floating therein in an appealing and highly visible form. The package of the present invention comprises a sleeve having two pairs of opposing flat walls extending from a base, one pair being relatively thin and the other being relatively wide. At each end of each pair of relatively thin walls is an orifice. The package also comprises a pair of caps, one being placed on each end of the sleeve and comprising a pair of flat sides and a pair of convex, curved sides. On each flat side lies a protrusion having a triangular cross-section, corresponding to the orifice on each end of the sleeve. The package additionally comprises a support therein having an intermediate portion, which in turn has an indented envelope for holding the product. The placement of the caps on each end of sleeve enables the protrusions to engage with the corresponding orifices, thereby securing the support and the product therein, and causing the opposing wide walls to bow outwards. The manual pressing of the bowed walls causes the caps to disengage from the sleeve.

20 Claims, 4 Drawing Sheets

PACKAGE

CROSS REFERENCE TO RELATED APPLICATION

This application claims priority of U.S. Provisional Application No. 60/357,896, filed Feb. 19, 2002, under Title 35, United States Code, Section 119(e).

BACKGROUND OF THE INVENTION

1. Field of the Invention

This invention relates to packaging, and in particular to clear packaging which enables a packaged product to appear to be floating inside the packaging so as to present the packaged item in an appealing and visible form, without requiring the use of additional fastening items such as tape or other fasteners.

2. Description of the Prior Art

There has been a desire to produce packaging for items which present the items in an apparently floating arrangement in the package, thereby rendering the item observable from many directions to potential customers. There have been such packages produced from transparent plastic materials, but they have heretofore suffered various disadvantages. In some cases, particularly with packages having flexible walls and/or covers, the use of adhesive tape or other fastening means are required to hold the components of the packaging in place. This could include both the portion which envelops the product in the package as well as the top and/or bottom of the package. In other instances, the packaging requires rigid, generally inflexible and relatively costly plastic, often has relatively complex latching means and can require excess manual labor in order to install the item being packaged, such as watches, clocks and other items having cosmetic appeal.

SUMMARY OF THE INVENTION

An object of the present invention is to provide packaging which firmly and securely holds its contents in place, but does not require an additional fastening means, other than the base, top and side or body portion.

Another object of the present invention is to provide improved packaging for displaying packaged products in an apparently floating relationship, which does not require tape or other fastening means for securing the package components together.

Yet another object of the present invention is to provide packaging which can be closed in a secure manner yet which can be opened without difficulty when required.

It is yet another object of the present invention to provide plastic packaging for displaying items in an apparently floating relationship with the package, which items can be packaged in a fast and efficient manner, and which package can be quickly and firmly closed.

It is yet an additional object of the present invention to provide an attractive plastic package which displays its contents in an appealing fashion and which can be opened and closed manually without the use of adhesive tape or other closing means.

These and other objects will be apparent from the description to follow.

The foregoing and other objects are achieved according to the preferred embodiment of the invention. According to the preferred embodiment, a package is provided having a hollow body portion or sleeve composed of flexible, preferably transparent plastic having geometric orifices near the top and bottom portion of the sleeve. The base and top of the packaging include rigid plastic caps having at least one opposing curved surface with depending collars having geometric protrusions configured and spaced to project through the orifices in the sleeve. When the end caps are installed in the sleeve, the depending collar slides on the inside surfaces of the sleeve to force the sleeve to obtain the same curvature as has the collar. The end caps are slid into the body portion until the protrusions enter and extend from the foregoing orifices. The engagement of the protrusion through the orifices holds the lids in place, and the tension caused by the bowing of the body portion to assume the curve of the top and base firmly holds the cover in place. In order to open the package, one simply presses on the curved body portion of the sleeve to cause the surfaces having the orifices to bend back from the cover to release the protrusions and allow the base or cover (i.e. one of the caps) to be expelled from the body portion. The sleeve can hold a plastic envelope or other carrier (i.e. a support or other support) for holding the item to be included in the package. The support can be a transparent sheet of plastic, like that of which the body portion is made, having an indentation in which the item is pressed and held in place. It is the support and the sleeve which makes the item appear as if it is floating in the package. The support can easily be held in the package, such as by having its length being equal to the distance the end caps are separated from each other. The walls of the sleeve should be sufficiently strong to prevent a bending of the walls to an extent to damage the item in the package or to allow the package to move downwardly near the bottom of the package. The support could have an indentation for the item as noted above, it could be a "bubble" for holding the item, or any other appropriate means depending on the item to be carried.

DETAILED DESCRIPTION OF THE PREFERRED EMBODIMENT

Figure 1:
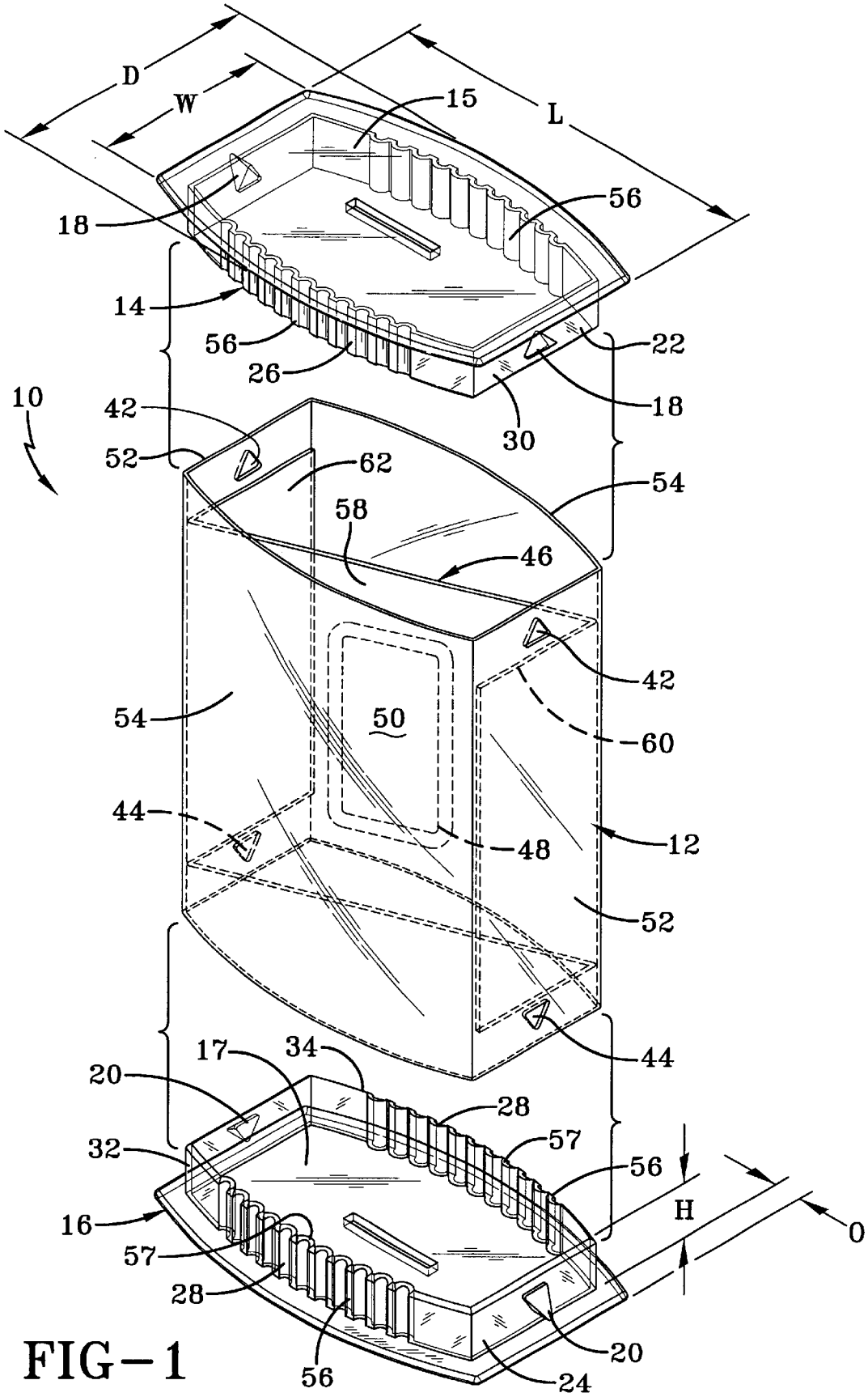
FIG. 1 is an exploded view of packaging according to the invention.
Figure 2:
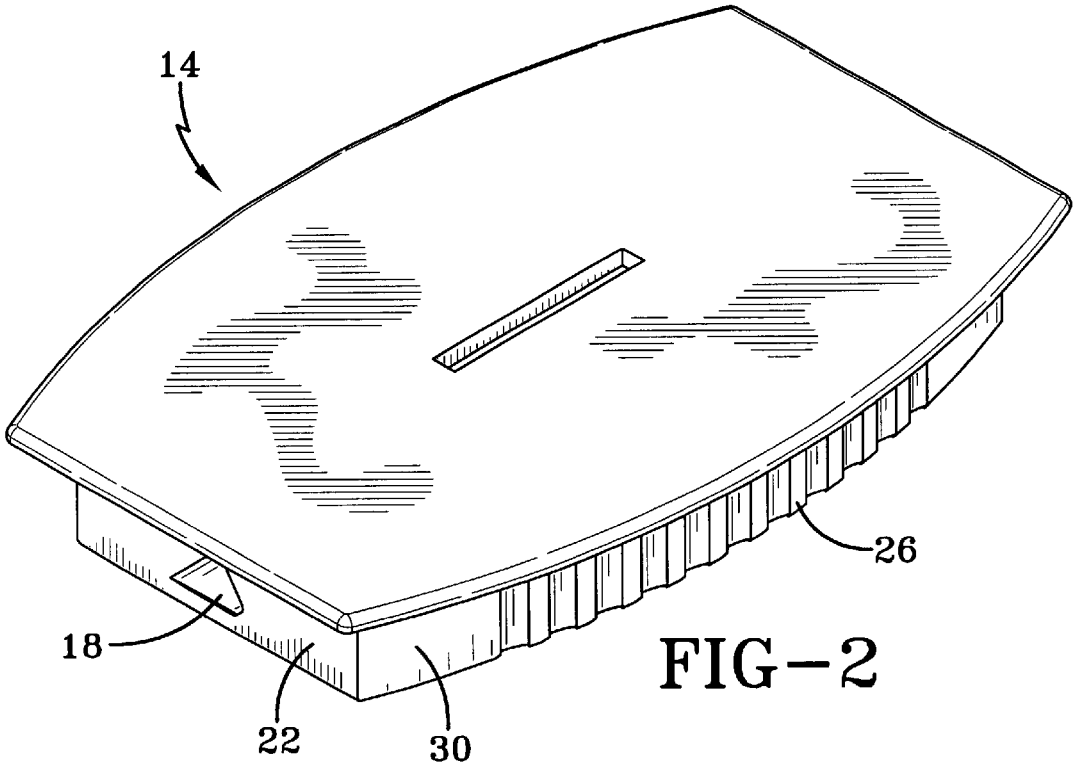
FIG. 2 is a perspective view of a cap according to the invention.
Figure 3:
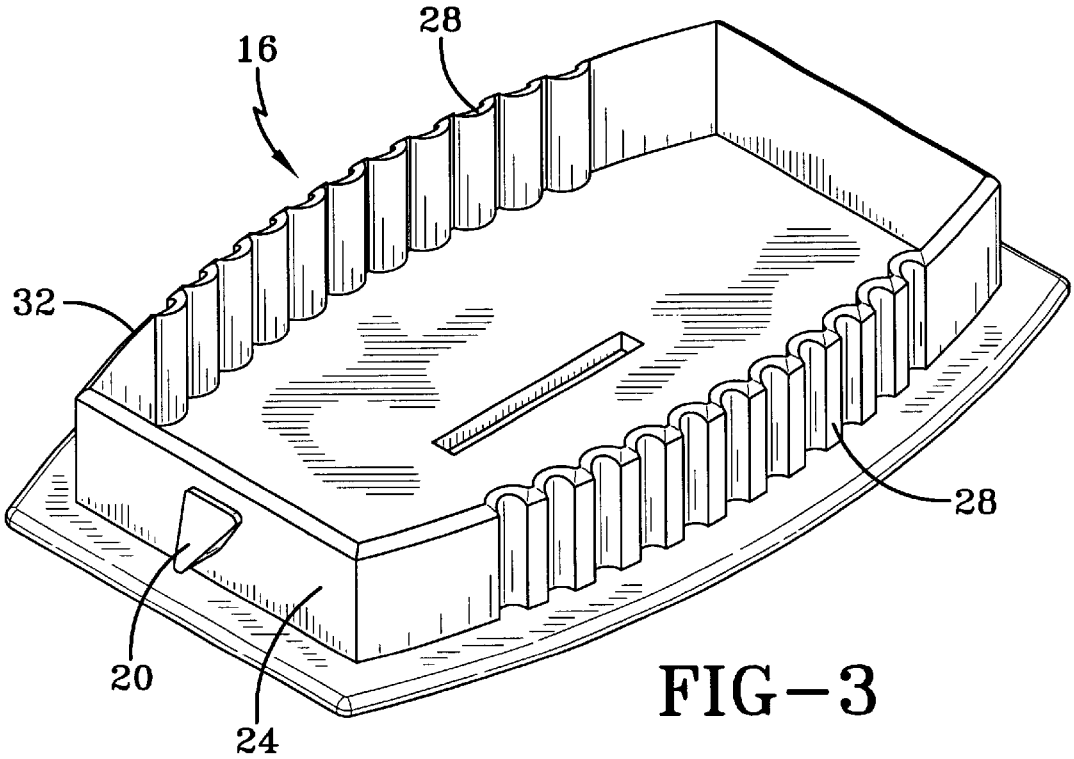
FIG. 3 is a perspective view of an additional cap according to the invention.

Turning to FIGS. 1–4, a preferred embodiment of the present invention is shown in exploded form and referred to at numeral 10. Package 10 is shown including a sleeve 12, a top cap 14 (see also FIG. 2), and a base cap 16 (see also FIG. 3). Caps 14 and 16 are preferably identical and they each have a pair of opposing protrusions one of which is shown for each of these components, namely, protrusion 18 and protrusion 20. Protrusions 18 and 20 are triangular in cross section. It should be appreciated, however, that protrusions 18 and 20 can be any other shape, such as square, circular, oval and the like. Top cap 14 and base cap 16 each have a base 15 and 17 respectively having opposite pairs of edges, pair of opposing straight, flat, parallel sides or walls 22 and 24, respectively, and a pair of opposing, convex curved sides or walls 26 and 28 respectively. Top cap 14 and base cap 16 have depending and upstanding collars 30 and 32, respectively as shown in the drawing. Collar 30 is comprised of the pair of opposing flat walls 22 joining curved walls 26. Likewise, collar 32 is comprised of the pair of opposing flat walls 24 and the pair of opposing convex curved walls 28. Walls 22 and 24 and walls 26 and 28 extend from each of respective bases 15 and 17. As will be clear from the description to follow, sleeve 12 has a pair of opposing orifices 42 on one end configured to receive protrusions 18, and is wide enough for the inner surface of the upper part of sleeve 12 to rest against the outer surface of collar 32. Likewise, the opposite end of sleeve 12 has orifices 44 for receiving protrusions 20, and is also wide enough to enable sleeve 12 to rest against the outer surface of collar 32. Sleeve 12 is transparent, and has a support 46 having a pocket or envelope 48 therein for holding an item 50 being displayed inside packaging 10. It can be seen that item 50 is apparently floating in packaging 10.

Figure 4:
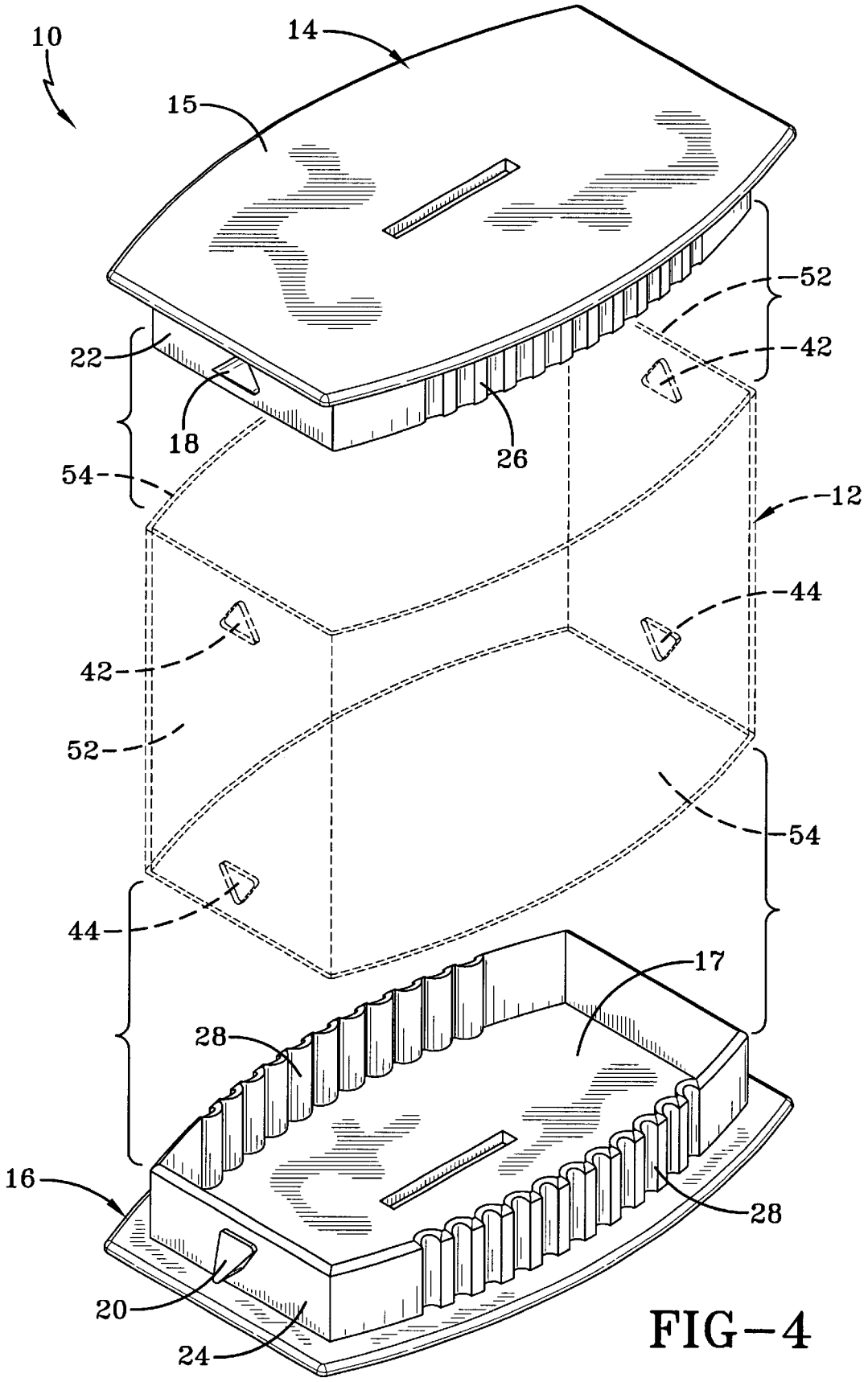
FIG. 4 is a perspective view of the packaging in operation, according to the invention.

Referring to FIGS. 1 and 4, sleeve 12 is shown having opposing flat parallel sides 52 and 54, respectively. Sleeve 12 is shown having one pair of flat parallel sides 54 being relatively wide in relation to the other pair of flat parallel sides 52. It should be appreciated of course that opposing flat parallel sides 52 and 54 respectively can have substantially the same width in relation to each other. When sleeve 12 is assembled with top cap 14 and base cap 16 in place, sides 54 are bowed as they engage with the curved or bowed walls 26 and 28 (FIG. 4). Likewise, when top cap and base cap 14 and 16 are attached to sleeve 12, protrusions 18 and 20 project through orifices 42 and 44, respectively. Top cap 14 and base cap 16 are identical structures. They respectively have collars 30 and 32 extending into the upper and lower open ends of sleeve 12. Top cap 14 and base cap 16 are made from rigid plastic material, such as ABS plastic. The rounded wall portions designated generally by numerical designator 56 enhance the strength of curved walls 26 and 28. Rounded wall portions 56 are further defined by a plurality of semi-lunar ridges designated generally by numerical designator 57, although other strength providing structural designs could be used.

Support 46 is shown as being a generally Z-shaped sheet of transparent, flexible plastic, as is used for sleeve 12. An appropriate material for each of these components is acetate. Support 46 has a long intermediate portion 58 which extends generally diagonally across sleeve 12, and is folded at its opposite ends to have short portions 60 and 62 which hold support 46 in place in slide 12. An indented envelope, pocket or receptacle 48 is provided intermediate to portion 58 for holding item 50 in place.

Turning now to FIG. 1, a preferred embodiment of the present invention is shown in operational mode. In order to assemble the components of package 10, carrier 46, with item 50 disposed in envelope 48, is inserted into sleeve 12. Caps 14 and 16 are manually pressed into the opposite open ends of sleeve 12 to cause both the bowing of opposing, convex curved walls 54 of sleeve 12 and the projection of protrusions 18 and 20 through orifices 42 and 44 respectively of sleeve 12. Package 10 can be assembled using different procedures, depending in part whether it is done manually or with an appropriate packaging machine.

In order to open the package, one simply manually presses the bowed walls 54 of sleeve 12 to effect the movement of the walls having orifices 42 and 44 away from the flat walls of top cap 14 and/or base cap 16 so that the orifices are disengaged from protrusions 18 and/or 20. This in turn expels one or both of top cap 14 and/or base cap 16, depending on where pressure is placed on sleeve 12.

The invention thus provides a very attractive packaging for items to be displayed in an apparently or seemingly floating manner. Package 10 can be made using conventional manufacturing techniques in a fast and effective manner. While sleeve 12 has been shown as having flat walls when not assembled with the end caps, it could have other shapes such as cylindrical, oval in cross section, or the like.

Package 10 can be made in a variety of forms. Two models which have been very effective are five inches high and 7.5 inches high, respectively. In both cases, the top and bottom, or end caps 14 and 16, are the same size and are substantially identical to each other. The length L shown in FIG. 1 is 4.5 inches, and the width W is about $2\frac{1}{16}^{th}$ inches. The distance D at the widest separation of the curved portions is three inches. The height H of the collar is one-half inch. The overlap O of the end of the caps is $\frac{3}{32}$ of an inch. Of course, many other dimensions could be used depending on the size of the package, the type of material used to construct the package, and the like. Many different kinds of plastics could be used, and it is generally preferred that transparent material be used in order to emphasize the floating relationship of the item held in the package. Many different colors could be used, and other designs could be incorporated in the package as well.

Figure 5:
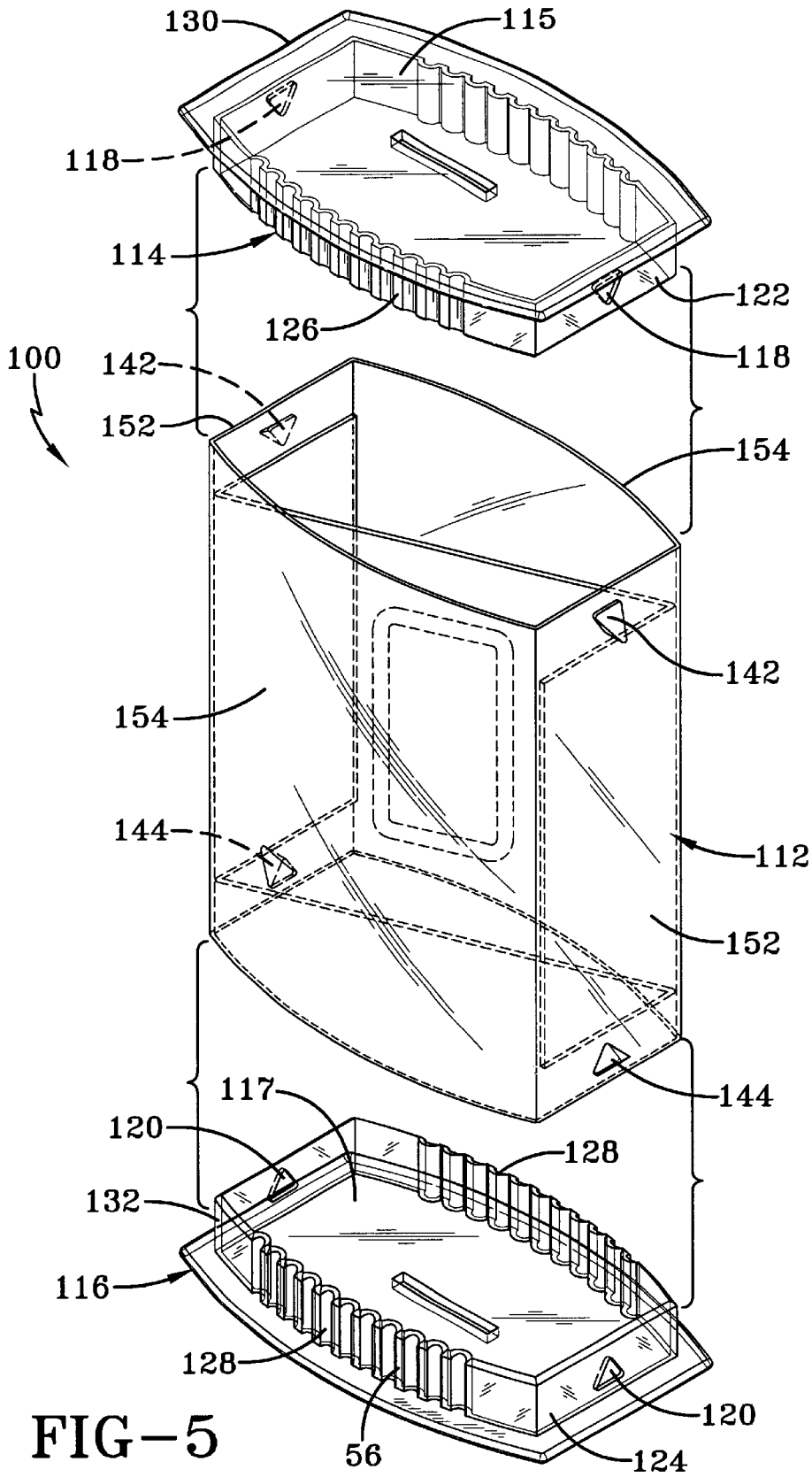
FIG. 5 is an exploded view of an alternative embodiment of the packaging according to the invention.

Turning now to FIG. 5, an alternative embodiment of the present invention is shown and referred to at reference numeral 100. Package 100 is shown including a sleeve 112, a top cap 114 and a base cap 116. Unlike in the embodiment described in the previous figures, caps 114 and 116 are preferably identical, but each has a pair of opposing orifices 118 and 120 respectively. Caps 114 and 116 are otherwise identical to those described supra, including having a pair of opposing straight, flat parallel sides or walls 122 and 124 respectively extending from a respective base 115 and 117, and a pair of opposing, convex curved sides or walls 126 and 128 respectively also extending from respective base 115 and 117. Caps 114 and 116 each have a depending and upstanding collar 130 and 132 respectively, which are both comprised of the pair of opposing flat walls 122 and 124 joining convex curved walls 126 and 128 respectively. Sleeve 112 comprises a pair of opposing flat parallel sides or walls 152 and 154 respectively, of which walls 154 are bowed when sleeve 112 is assembled with caps 114 and 116 in place. Sleeve 112 differs from that described above in that sleeve 112 further comprises a pair of protrusions 142 on one end configured to be inserted into orifices 118. Likewise, the opposite end of sleeve 112 has protrusions 144 for being inserted into orifices 120 on cap 116. In all other respects, sleeve 112 is identical to sleeve 12 described above.

The invention has been described in detail with particular emphasis on the preferred embodiment thereof, but variations and modifications may occur to those skilled in the art to which the invention pertains.

What is claimed is:

1. A package enabling a product to appear to be floating therein, comprising:

a sleeve having two pairs of opposing flat parallel sides, said sleeve having opposite open ends;

a pair of caps for being disposed on the opposite ends of said sleeve, each cap comprising a base having opposite pair of edges, a pair of flat, parallel opposing sides extending from one pair of said base edges, and a pair of opposing convex curved sides extending from the other pair of said base edges, and protrusions having a geometrical shape extending from each of said opposing flat sides; and each cap being placeable on an end of said sleeve, wherein one of said pair of opposing sides of said sleeve for receiving said pair of sides of said cap with said protrusions has a pair of opposing orifices having the same geometrical shape as said protrusions and located to receive said protrusions to releasably lock said cap in place relative to said sleeve.

2. The package according to claim 1, and further including a support therein having a receptacle for holding said product.

3. The package according to claim 1 wherein said pairs of opposing sides are equilateral.

4. The package according to claim 1 wherein a first pair of said pairs of opposing sides has a relatively wide width and a second pair has a relatively narrow width.

5. The package according to claim 1, wherein said protrusions and said orifices have a cross-section selected from the group consisting of triangular, square, circular, oval, ovoid and polygonal.

6. The package according to claim 1, wherein said sleeve is transparent.

7. The package according to claim 2, wherein said support further comprises a long intermediate portion for securing said product, and a pair of oppositely folded short portions for further securing said support within said sleeve.

8. The package according to claim 7, wherein said receptacle of said intermediate long portion further comprises an indent in said intermediate portion for securing said product in place.

9. The package according to claim 1, wherein the placement of said caps on an opposite end of said sleeve causes said pair of opposing relatively wide sides of said sleeve to become bowed.

10. The package according to claim 9, wherein the manual pressing of said bowed wide sides causes said protrusions to disengage from said corresponding orifices, thereby expelling at least one of said caps from said sleeve.

11. A package enabling a product to appear to be floating therein, comprising:

a sleeve having two pairs of opposing flat parallel sides, said sleeve having opposite open ends;

a pair of caps for being disposed in the opposite ends of said sleeve, each cap comprising a base having opposite pairs of edges, a pair of flat, parallel opposing sides extending from one pair of edges, and a pair of opposing convex curved sides extending from the other pair of said base edges, and a pair of opposing orifices having a geometrical shape on each of said opposing flat sides; and each cap being placeable on an end of said sleeve, and wherein one of said pair of opposing sides of said sleeve for receiving said pair of sides of said cap with said orifices has a pair of opposing protrusions having the same geometrical shape as said orifices and located to receive said orifices to releaseably lock said cap in place relative to said sleeve.

12. The package according to claim 11, and further including a support therein having a receptacle for holding said product.

13. The package according to claim 11 wherein said pairs of opposing sides are equilateral.

14. The package according to claim 11 wherein a first pair of said pairs of opposing sides has a relatively wide width and a second pair has a relatively narrow width.

15. The package according to claim 11, wherein said protrusions and said orifices have a cross-section selected from the group consisting of triangular, square, circular, oval, ovoid and polygonal.

16. The package according to claim 11, wherein said sleeve is transparent.

17. The package according to claim 12, wherein said support further comprises a long intermediate portion for securing said product, and a pair of oppositely folded short portions for further securing said support within said sleeve.

18. The package according to claim 17, wherein said receptacle of said intermediate long portion further comprises an indent in said intermediate portion for securing said product in place.

19. The package according to claim 11, wherein the placement of said caps on an opposite end of said sleeve causes said pair of opposing relatively wide sides of said sleeve to become bowed.

20. The package according to claim 19, wherein the manual pressing of said bowed wide sides causes said protrusions to disengage from said corresponding orifices, thereby expelling at least one of said caps from said sleeve.

* * * * *